US007011155B2

(12) United States Patent
Meister et al.

(10) Patent No.: US 7,011,155 B2
(45) Date of Patent: Mar. 14, 2006

(54) FORMATION TESTING APPARATUS AND METHOD FOR OPTIMIZING DRAW DOWN

(75) Inventors: Matthias Meister, Celle (DE); Jaedong Lee, Houston, TX (US); Sven Krueger, Celle (DE); Eick Niemeyer, Hanover (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/423,420

(22) Filed: Apr. 25, 2003

(65) Prior Publication Data

US 2004/0026125 A1 Feb. 12, 2004

Related U.S. Application Data

(63) Continuation-in-part of application No. 09/910,624, filed on Jul. 20, 2001, now Pat. No. 6,568,487, and a continuation-in-part of application No. 09/910,209, filed on Jul. 20, 2001, now Pat. No. 6,609,568.

(51) Int. Cl.
*E21B 49/00* (2006.01)
*E21B 47/10* (2006.01)

(52) U.S. Cl. ..... 166/250.01; 166/264; 166/100; 175/50; 73/152.52; 73/152.05

(58) Field of Classification Search ..... 73/152.05, 73/152.24, 152.28, 152.52; 166/264, 100, 166/250.01; 175/50
See application file for complete search history.

(56) References Cited

U.S. PATENT DOCUMENTS

| | | | | | |
|---|---|---|---|---|---|
| 3,321,965 | A | | 5/1967 | Johnson et al. | 73/155 |
| 4,803,873 | A | * | 2/1989 | Ehlig-Economides | 73/152.31 |
| 4,890,487 | A | * | 1/1990 | Dussan et al. | 73/152.05 |
| 5,233,866 | A | | 8/1993 | Desbrandes | 73/155 |
| 5,602,334 | A | * | 2/1997 | Proett et al. | 73/152.05 |
| 5,644,076 | A | * | 7/1997 | Proett et al. | 73/152.41 |
| 5,703,286 | A | | 12/1997 | Proett et al. | 73/152.05 |
| 5,708,204 | A | | 1/1998 | Kasap | 73/152.52 |
| 5,789,669 | A | * | 8/1998 | Flaum | 73/152.51 |
| 5,803,186 | A | | 9/1998 | Berger et al. | 175/50 |
| 6,427,530 | B1 | * | 8/2002 | Krueger et al. | 73/152.46 |
| 6,474,152 | B1 | * | 11/2002 | Mullins et al. | 73/152.22 |
| 6,581,455 | B1 | | 6/2003 | Berger et al. | 73/152.55 |
| 6,675,892 | B1 | | 1/2004 | Kuchuk et al. | 166/250.02 |
| 6,761,062 | B1 | * | 7/2004 | Shapiro | 73/152.41 |
| 6,832,515 | B1 | | 12/2004 | Follini et al. | 73/152.02 |
| 2001/0050170 | A1 | | 12/2001 | Woie et al. | 166/252.1 |
| 2002/0185313 | A1 | | 12/2002 | Jones et al. | 175/48 |
| 2003/0094040 | A1 | * | 5/2003 | Proett et al. | 73/152.05 |
| 2004/0045706 | A1 | | 3/2004 | Pop et al. | 166/250.07 |
| 2004/0050588 | A1 | | 3/2004 | Follini et al. | 175/50 |
| 2004/0231408 | A1 | | 11/2004 | Shammai | 73/152.27 |
| 2005/0087009 | A1 | | 4/2005 | Follini et al. | 73/152.59 |

FOREIGN PATENT DOCUMENTS

| | | |
|---|---|---|
| EP | 0490421 A1 | 6/1992 |
| EP | 0520903 A2 | 12/1992 |
| EP | 0698722 A2 | 2/1996 |

* cited by examiner

*Primary Examiner*—David Bagnell
*Assistant Examiner*—Shane Bomar
(74) *Attorney, Agent, or Firm*—Madan, Mossman & Sriram, P.C.

(57) ABSTRACT

A method and apparatus for of determining a formation parameter of interest. The method includes placing a tool into communication with the formation to test the formation, determining a first formation characteristic during a first test portion, initiating a second test portion, the second test portion having test parameters determined at least in part by the determinations made during the first test portion, determining a second formation characteristic during the second test portion, and determining the formation parameter from one of the first formation characteristic and the second formation characteristic. The apparatus includes a draw down unit and a control system for closed loop control of the draw down unit. A microprocessor in the control system processes signals from a sensor in the draw down unit to determine formation characteristics and to determine test parameters for subsequent test portions.

15 Claims, 6 Drawing Sheets

FORMATION TESTING APPARATUS AND METHOD FOR OPTIMIZING DRAW DOWN

CROSS REFERENCE TO RELATED APPLICATIONS

The present application is a continuation-in-part of U.S. patent application Ser. No. 09/910,624 for "Procedure for Fast and Extensive Formation Evaluation with Minimum System Volume" filed on Jul. 20, 2001 now U.S. Pat. No. 6,568,487, the specification of which is incorporated herein by reference, and is further a continuation-in-part of U.S. patent application Ser. No. 09/910,209 for "Closed-Loop Drawdown Apparatus and Method for In-situ Analysis of Formation Fluids" filed on Jul. 20, 2001 now U.S. Pat. No. 6,609,568, the specification of which is incorporated herein by reference.

BACKGROUND OF THE INVENTION

1. Field of the Invention

This invention generally relates to the testing of underground formations or reservoirs. More particularly, this invention relates to a method and apparatus for real-time test verification using closed-loop control of a draw down system.

2. Description of the Related Art

To obtain hydrocarbons such as oil and gas, well boreholes are drilled by rotating a drill bit attached at a drill string end. The drill string may be a jointed rotatable pipe or a coiled tube. A large portion of the current drilling activity involves directional drilling, i.e., drilling boreholes deviated from vertical and/or horizontal boreholes, to increase the hydrocarbon production and/or to withdraw additional hydrocarbons from earth formations. Modern directional drilling systems generally employ a drill string having a bottom hole assembly (BHA) and a drill bit at an end thereof that is rotated by a drill motor (mud motor) and/or the drill string. A number of down hole devices placed in close proximity to the drill bit measure certain down hole operating parameters associated with the drill string. Such devices typically include sensors for measuring down hole temperature and pressure, azimuth and inclination measuring devices and a resistivity-measuring device to determine the presence of hydrocarbons and water. Additional down hole instruments, known as measurement-while-drilling (MWD) or logging-while-drilling (LWD) tools, are frequently attached to the drill string to determine formation geology and formation fluid conditions during the drilling operations.

One type of while-drilling test involves producing fluid from the reservoir, collecting samples, shutting-in the well, reducing a test volume pressure, and allowing the pressure to build-up to a static level. This sequence may be repeated several times at several different reservoirs within a given borehole or at several points in a single reservoir. This type of test is known as a "Pressure Build-up Test." One important aspect of data collected during such a Pressure Build-up Test is the pressure build-up information gathered after drawing down the pressure in the test volume. From this data, information can be derived as to permeability and size of the reservoir. Moreover, actual samples of the reservoir fluid can be obtained and tested to gather Pressure-Volume-Temperature data relevant to the reservoir's hydrocarbon distribution.

Some systems require retrieval of the drill string from the borehole to perform pressure testing. The drill string is removed, and a pressure measuring tool is run into the borehole using a wireline tool having packers for isolating the reservoir. Although wireline conveyed tools are capable of testing a reservoir, it is difficult to convey a wireline tool in a deviated borehole.

The amount of time and money required for retrieving the drill string and running a second test rig into the hole is significant. Further, when a hole is highly deviated wireline conveyed test figures cannot be used because frictional force between the test rig and the wellbore exceed gravitational force causing the test rig to stop before reaching the desired formation.

A more recent system is disclosed in U.S. Pat. No. 5,803,186 to Berger et al. The '186 patent provides a MWD system that includes use of pressure and resistivity sensors with the MWD system, to allow for real time data transmission of those measurements. The '186 device enables obtaining static pressures, pressure build-ups, and pressure draw-downs with a work string, such as a drill string, in place. Also, computation of permeability and other reservoir parameters based on the pressure measurements can be accomplished without removing the drill string from the borehole.

Using a device as described in the '186 patent, density of the drilling fluid is calculated during drilling to adjust drilling efficiency while maintaining safety. The density calculation is based upon the desired relationship between the weight of the drilling mud column and the predicted down hole pressures to be encountered. After a test is taken a new prediction is made, the mud density is adjusted as required and the bit advances until another test is taken.

A drawback of this type of tool is encountered when different formations are penetrated during drilling. The pressure can change significantly from one formation to the next and in short distances due to different formation compositions. If formation pressure is lower than expected, the pressure from the mud column may cause unnecessary damage to the formation. If the formation pressure is higher than expected, a pressure kick could result.

Such formation pressure testing can be hampered by a variety of factors including insufficient draw down volume, tool or formation plugging during a test, seal failure, or pressure supercharging. These factors can result in false pressure information. Pressure tests with excessive draw rate, i.e. the rate of volume increase in the system, or tests with an insufficient draw volume should be avoided. The excessive draw rate often results in an excessive delta pressure drop between the test volume and the formation causing long build up times. Moreover, compressibility of fluid in the tool will dominate the pressure response if the formation cannot provide enough fluid for the excessive pressure drop. With an excessive draw rate the pressure drop can exceed the fluid bubble point thereby causing gas to evolve from the fluid and corrupt the test result.

With insufficient draw down volume pressure in the tool will not fall below the formation pressure resulting in little or no pressure build up. In very permeable formations, insufficient draw down volume can falsely indicate a tight formation.

Pressure supercharging, or simply supercharging, exists when pressure at the sandface near the borehole wall is greater than the true formation pressure. Supercharging is caused by fluid invasion from the drilling process that has not completely dissipated into the formation. Supercharging is also caused by annulus fluid pressure bypassing a seal through the mudcake. Consequently, measured pressure information is typically measured more than once to provide verification of the information.

The typical verification test involves multiple draw down tests where using identical draw down parameters, e.g. draw rate, delta pressure and test duration. In some cases, the parameters might be varied according to a predetermined verification protocol. The multiple draw test using the same test parameters suffers from inefficiency of time and the possibility of repeating erroneous results. Merely following a predetermined test protocol does not increase efficiency, because the protocol might not address real-time conditions in a timely manner. Furthermore, predetermined protocols will not necessarily verify previous test results.

Any of the above identified problems can lead to false information regarding formation properties and to wasted rig time. Therefore, there is a need to provide a method and apparatus for performing multiple verification tests without operator intervention.

SUMMARY OF THE INVENTION

The present invention addresses some of the drawbacks discussed above by providing a measurement while drilling apparatus and method which enables sampling and measurements of formation and/or tool parameters used to reduce the time required for verifying test results.

One aspect of the present invention provides a method for determining a parameter of interest of a formation. The method comprises conveying a tool into a well borehole traversing a formation and placing the tool into communication with the formation to test the formation using a first test portion and a second test portion. A first formation or tool characteristic is determined during the first test portion, and the second test portion is initiated using test parameters determined at least in part by the determinations made during the first test portion. A second formation or tool characteristic is determined during the second test portion, and the desired formation parameter is determined from one or more of the first formation characteristic and the second formation characteristic.

In one method according to the present invention, the first test portion can be a standard draw cycle wherein a test volume is placed in fluidic communication with the formation and the test volume is increased at a constant rate for a period of time to reduce the test volume pressure below the formation pressure. The test volume is then held constant to allow the pressure to build in the volume. One or more determinations are made, which can be mobility, formation pressure, and/or compressibility. The determination is used to determine optimal test parameters for the subsequent test portion. The second test portion is then initiated using the new test parameters, which can be a change in draw rate, draw duration, and/or delta pressure.

The first test portion can be an initial draw portion of a pressure test and the second test portion can be a second draw portion of a single draw cycle. Formation characteristics determined during the initial draw portion are used to determine a second draw rate for use in the second draw portion. The second draw portion can be a rate to create a steady state pressure while fluid continues to flow into the tool.

A quality factor or indicator can be assigned to any portion of the test, where the quality indicator is determined from a formation rate analysis. The quality indicator is a correlation of flow rates to pressure, which correlation is represented by a straight line equation. Extrapolation can then be used to determine and/or verify formation pressure. Thus, in one embodiment a desired formation parameter can be determined during the first test portion and verified by the quality indicator and the second test portion can therefore be an abort to shorten the overall test time.

Another method according to the present invention provides controlling a down hole test tool. The method includes conveying the tool into a borehole, placing the tool in communication with a formation traversed by the borehole. Tool characteristics are determined during a first test portion, and a second test portion is controlled by establishing test parameters based on the tool characteristics determined during the first test portion.

Another aspect of the present invention provides an apparatus for determining a desired formation parameter of interest. The apparatus includes a tool conveyable into a well borehole traversing a formation. The tool is adapted for fluidic communication with the formation. A test unit in the tool is used to test the formation, the test including a first test portion and a second test portion. A controller is associated with the test unit for controlling test parameters used by the test unit. The test unit includes a device for determining a first formation or tool characteristic during the first test portion. The second test portion is initiated with test parameters determined at least in part by the determinations made during the first test portion. The device then determines a second formation or tool characteristic during the second test portion. A processor is included for determining the desired formation parameter from one or more of the first characteristic and the second characteristic.

In one embodiment, the test unit and controller operate closed-loop and autonomously after the test is initiated. The tool is conveyed down hole on a work string (drill string or wireline) and is placed in communication with the formation to test the formation. A sensor determines a characteristic (tool or formation) during a first test portion. A controller receives a sensor signal from the sensor and operates according to programmed instructions to process the received signals to establish test parameters based at least in part on the determined characteristic. A circuit associated with the controller and the tool is used for applying the test parameters to a second test portion.

In yet another aspect of the present invention is a system for determining in situ a desired formation parameter of interest. The system includes a work string for conveying a tool into a well borehole traversing a formation and a test unit in the tool, the test unit being adapted for communication with the formation to test the formation, the test including a first test portion and a second test portion. A sensor in the tool is used for determining a first characteristic during the first test portion. A controller receives an output signal from the senor, the controller operating according to one or more programmed instructions to process the received signals to establish one or more test parameters based at least in part on the determined characteristic. A circuit is associated with the controller and the tool for applying the test parameters to a second test portion, the sensor determining a second characteristic during the second test portion. A processor processes the first characteristic and the second characteristic to provide processed information, the processed information being indicative of the formation parameter of interest.

BRIEF DESCRIPTION OF THE DRAWINGS

The novel features of this invention, as well as the invention itself, will be best understood from the attached drawings, taken along with the following description, in which similar reference characters refer to similar parts and wherein.

DESCRIPTION OF THE PREFERRED EMBODIMENT

Figure 1A:
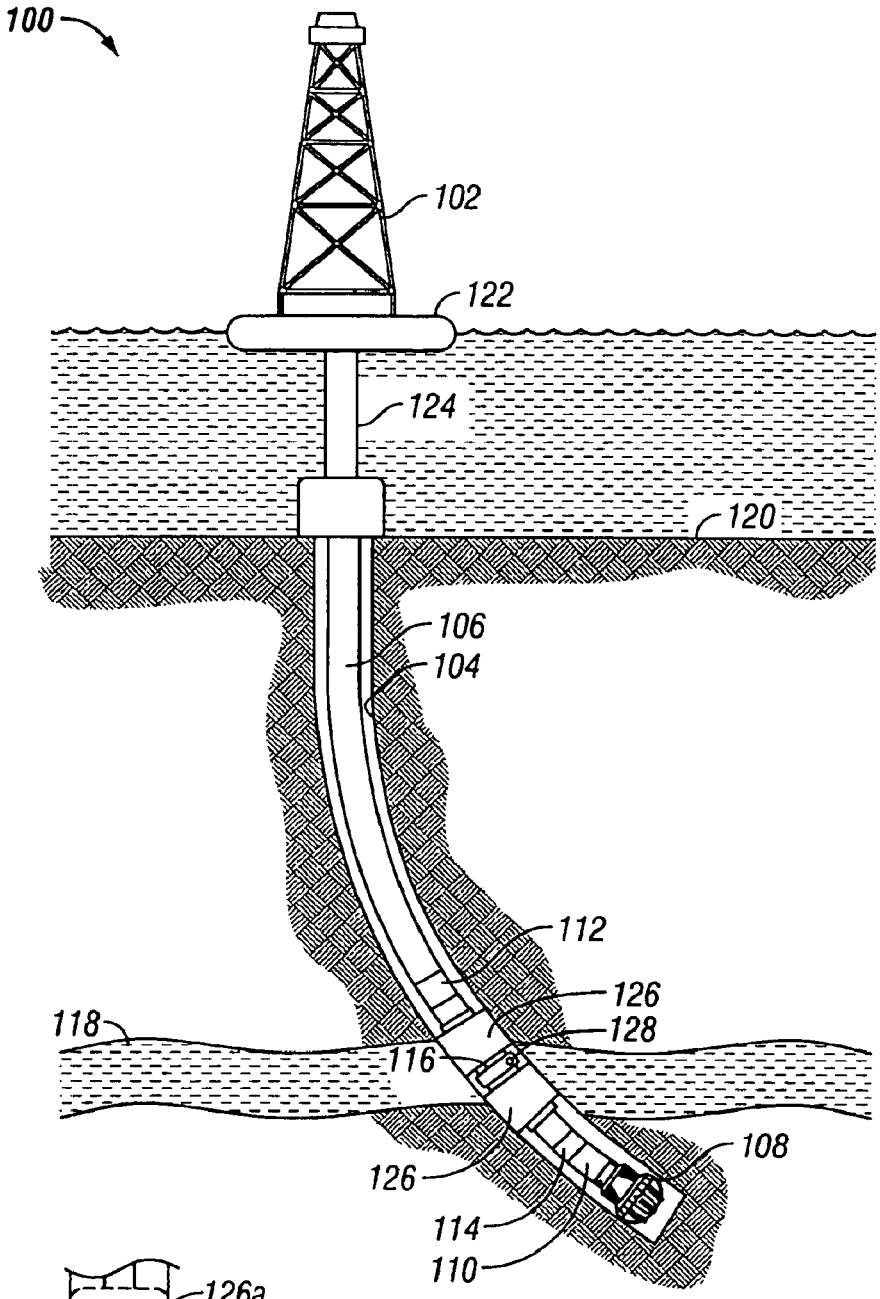
FIG. 1A is an elevation view of an offshore drilling system according to one embodiment of the present invention.

FIG. 1A is a drilling apparatus 100 according to one embodiment of the present invention. A typical drilling rig 102 with a borehole 104 extending therefrom is illustrated, as is well understood by those of ordinary skill in the art. The drilling rig 102 has a work string 106, which in the embodiment shown is a drill string. The drill string 106 has attached thereto a drill bit 108 for drilling the borehole 104. The present invention is also useful in other types of work strings, and it is useful with a wireline, jointed tubing, coiled tubing, or other small diameter work string such as snubbing pipe. The drilling rig 102 is shown positioned on a drilling ship 122 with a riser 124 extending from the drilling ship 122 to the sea floor 120. However, any drilling rig configuration such as a land-based rig or a wireline may be adapted to implement the present invention.

Figure 1B:
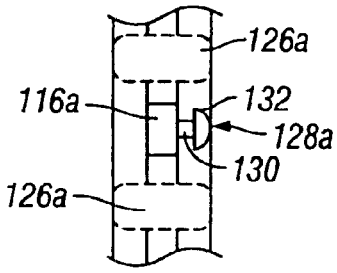
FIG. 1B shown an alternative embodiment of the test apparatus in FIG. 1A.

If applicable, the drill string 106 can have a down hole drill motor 110. Incorporated in the drill string 106 above the drill bit 108 is a typical testing unit, which can have at least one sensor 114 to sense down hole characteristics of the borehole, the bit, and the reservoir, with such sensors being well known in the art. A useful application of the sensor 114 is to determine direction, azimuth and orientation of the drill string 106 using an accelerometer or similar sensor. The BHA also contains the formation test apparatus 116. The test apparatus 116 preferably includes a sealing device 126 and port 128 to provide fluidic communication with an underground formation 118. The seal 126 can be known expandable packers as shown, or as shown in FIG. 1B, the seal 126 can be a pad 132 on an extendable probe 130 where the extendable probe 130 is part of a test apparatus 116*a*. It is also contemplated and within the scope of the present invention to include an extendable probe 130, with or without a pad seal 132, in the test apparatus 116*a* to extend and contact the formation below one packer 126*a* or between a pair of packers 126*a*. The packers 126*a* are shown in dashed form to indicate that the packers are desirable but optional when the test apparatus 116*a* includes an extendable probe 130 with a pad seal 132. Extendable probes with sealing pads are known, and do not require further illustration here. The test device 116/116*a* will be described in greater detail with respect to FIG. 2. A telemetry system 112 is located in a suitable location on the work string 106 such as above the test apparatus 116. The telemetry system 112 is used for command and data communication between the surface and the test apparatus 116.

Figure 2:
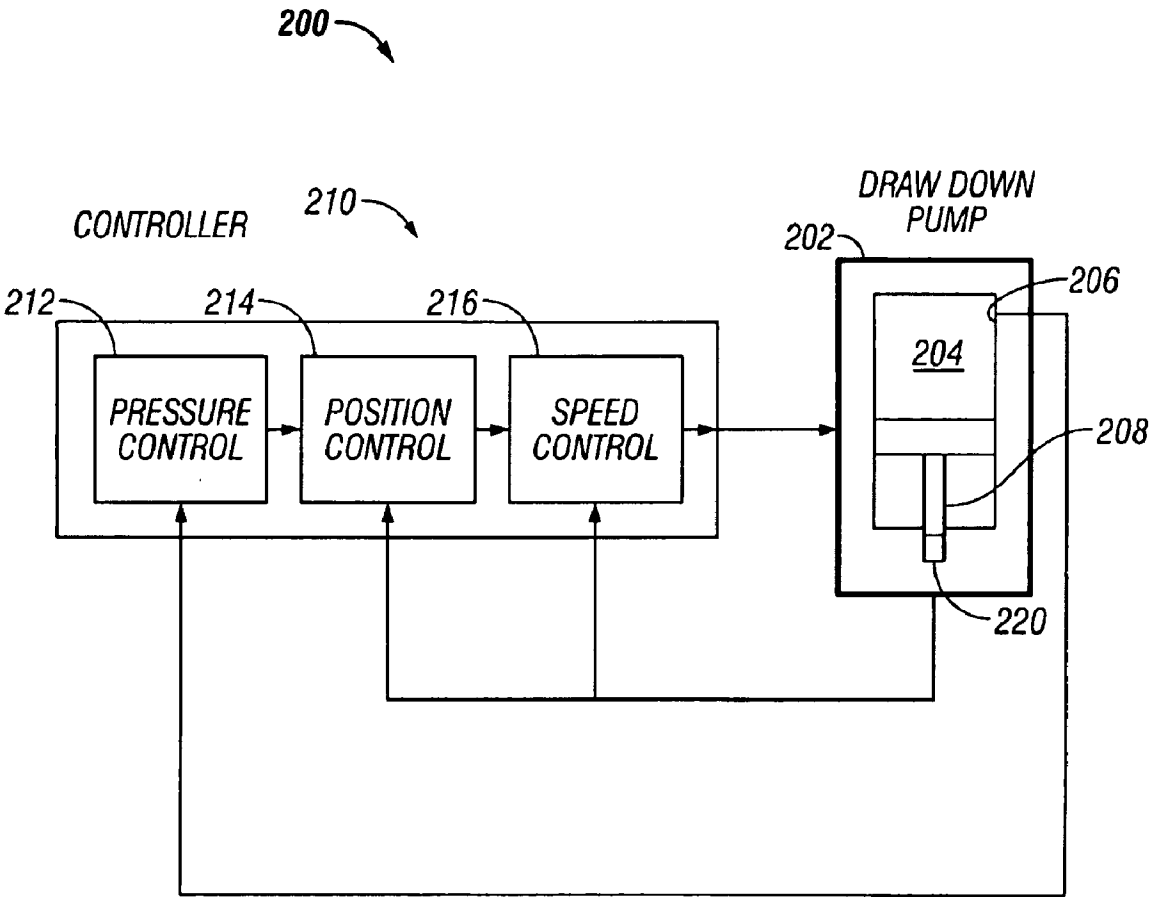
FIG. 2 shows a draw down unit and closed-loop control according to the present invention.

FIG. 2 illustrates a test device with closed loop control according to the present invention. The device 200 includes draw down unit 202 having a test volume 204 and a member 206 for controlling volume of the test volume. A sensor 206 is associated with the test volume to measure characteristics of fluid in the volume.

The test volume 204 is preferably integral to a flow line in fluidic communication with the formation. Such a device minimizes the overall system volume, which provides more responsiveness to formation influence, e.g., pressure response. The volume, however, need not be limited to a small volume. For example, the methods associated with the present invention are useful in drill stem testing, which typically includes a large system volume.

The volume control member 208 is preferably a piston, but can be any other useful device for changing a test volume. Alternatively, the member can be a pump or other mover to reduce pressure within the test volume 204.

The sensor 206 is preferably a quartz pressure sensor. The sensor, however, might alternatively be or further include other sensors as desired. Other sensors that might be of use in variations of the methods described herein might include temperature sensors, flow sensors, nuclear detectors, optical sensors, resistivity sensors, or other known sensors to measure characteristics of the volume 204.

The device further includes a controller 210 for controlling the test unit 202. The controller preferably includes a microprocessor 218 and circuitry for piston (or pump) pressure control 212, position control 214, and speed control 216. One or more sensors 220 associated with the draw down system are used to send signals to the controller to provide closed loop control.

The test device 200 performs the formation pressure test within a brief drilling pause of about five minutes, which is the time needed to add another drill pipe when the device is incorporated into a drilling BHA. This short test period reduces the risk of differential sticking during drilling through a depleted reservoir section where the drilling process should not be interrupted for an extended time with the BHA stationary in the hole.

The controller 210 includes storage for processed data and for programs to conduct data processing down hole. The programs for determining formation parameters from the measured values are used in conjunction with the pump control circuits to provide closed loop control for position, speed, and pressure control.

For pressure measurements a high accuracy quartz pressure gauge 206 is preferred for its good resolution. Less preferred pressure sensors that could also be used are strain gauge or piezoelectric resistive transducers. In a preferred embodiment, the pressure transducer is disposed very close to a pad sealing element 126. Such a sensor placement overcomes problems experienced in wireline measurements that lack accuracy when gas is accumulated in the flow line.

Preferably, the tool includes sufficient electronic memory to store up to 200 or more test results for further detailed post-run analysis after the data are dumped at the surface. With these data a logging engineer might further interpret the pressure data and correlate them to the geology and pressure measurements from neighboring wells.

To control the formation test tool down hole, initiation signals are sent from the surface to the tool utilizing standard mud pulse telemetry. The down hole controller is preferably programmed to perform a test according to the present invention to be described in detail later. The expected overbalance and mobility are preferably programmed for a particular well to further accelerate the optimization process and, therefore, decrease the overall measurement time.

When the test begins, the tool preferably operates in an autonomous mode to perform the test independently. The tool can be shut down as an emergency function by cycling mud pumps to signal a command to stop the measurement process.

A preferred test in a horizontal well application begins with a tool face measurement to provide an indication that the pad sealing element is not pushed downwards against the formation where the cutting bed is located. Such an orientation would likely result in an inability to seal or in tool plugging. If the pad sealing element is pointing downwards, the actual position is transmitted to the surface to allow a new orientation of the tool by rotating the tool from the surface.

Once the tool is oriented properly, the pad sealing element is pushed against the borehole wall in a controlled manner. The sealing pressure is continuously monitored until effective sealing is achieved. A small pressure increase of the internal system volume measured by the quartz gauge indicates a good seal.

Depending on the test option selected, the tool begins its pressure measurement process. The tool releases the pad sealing element from the borehole wall and transmits the measured data to the surface via mud pulse telemetry after completion of each test or series of tests as desired. At the surface the following data are preferably made available: two annular pressures (before and after the test), up to three or more formation pressures of the individual pressure tests, drawdown pressures of the first two tests, the mobility value calculated from the last test, and a quality indicator from the correlation factor when formation rate methods are used.

Thus, data are directly available immediately after each test or series of tests and can be utilized for the further planning of the borehole. By providing repeat measurements, the pressure data can be compared from just one pressure measurement. This provides high confidence in the pressure test since errors in the pressure measurement process due to leaking or other effects can be observed directly in varying pressure data.

Figure 3:
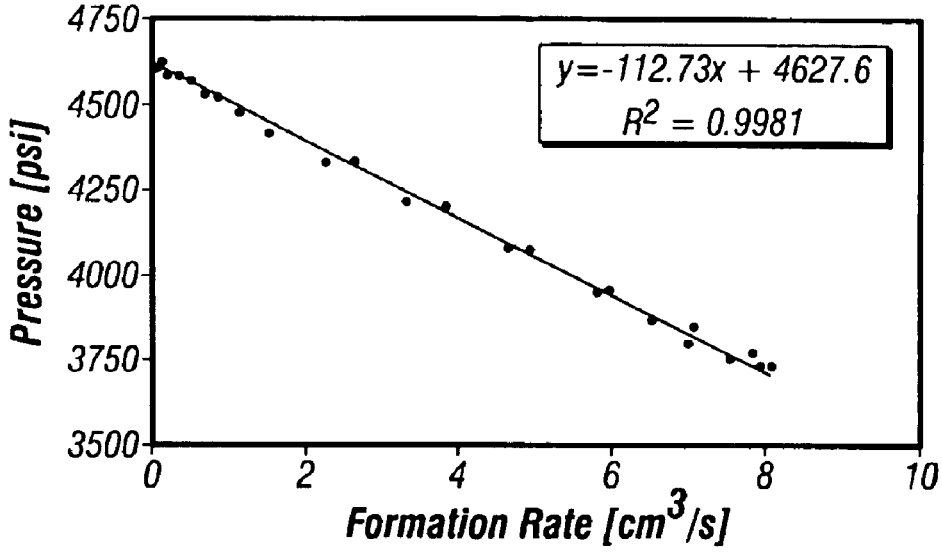
FIG. 3 is a graph to illustrate formation testing using flow rate.

Now that the tool and general test procedure have been described, methods of testing the formation for various parameters of interest will now be described in detail. FIG. 3 shows a flow rate plot for use in an analytical technique known as flow rate analysis (FRA). U.S. Pat. No. 5,708,204 to Kasap, which is incorporated herein by reference, describes a basic FRA technique. FRA provides extensive analysis of pressure drawdown and build-up data. The mathematical technique employed in FRA is a form of multi-variant regression analysis. Using multi-variant regression calculations, parameters such as formation pressure (p*), fluid compressibility (C) and fluid mobility (m) can be determined simultaneously when data representative of the build up process are available.

The FRA technique is based on the material balance for the formation test tool flow-line volume with the consideration of pressure and compressibility of the enclosed volume. In equation (1) the standard Darcy equation is shown $$q \approx \frac{k}{\mu} \cdot \Delta p, \quad \text{or} \quad q = \frac{kA}{\mu} \cdot \frac{\Delta p}{L} \tag{1}$$

which establishes the proportional relationship between flow rate (q), permeability (k), dynamic viscosity ($\mu$), and the differential pressure ($\Delta p$). The same applies if fluid is flowing through a core with the cross-section surface (A) and the length (L) as in the case of a drill stem test. A key contribution of FRA is to use the formation rate in the Darcy Equation instead of a piston withdrawal rate. The formation rate is calculated by correcting the drawdown piston rate for tool storage effects. Representing the complex flow geometry of probe testing with a geometric factor makes the FRA technique more practical to obtain formation pressure (p *), permeability, and fluid compressibility.

Darcy's equation is expressed with a geometric factor for isothermal, steady-state flow of a liquid when the inertial flow (Forchheimer) resistance is negligible, $$q_f = \frac{kG_o r_i (p^* - p(t))}{\mu}, \tag{2}$$

where $q_f$ is the volumetric flowrate into the probe from the formation, p* is the formation pressure, and p(t) is the pressure in the probe as a function of time. $G_o$ is a geometric factor that accounts for the unique flow geometry near probe including the wellbore. Using this modified Darcy's equation and compressibility equation for the tool storage effect, the material balance equation can be rearranged as:

$$p(t) = p^* - \left(\frac{\mu}{kG_o r_i}\right)\left(C_{sys} V_{sys} \frac{dp(t)}{dt} + q_{dd}\right). \tag{3}$$

The fluid compressibility in the tool flowline is $C_{sys}$, and $V_{sys}$ is the volume of the flowline. Note that the terms within the last parentheses in Eq. 3 correspond to accumulation and piston drawdown rates ($q_{dd}$), respectively. These rates act against each other during a drawdown period and together during a buildup period, but in essence the combination is the flow rate from the formation. Eq. 3 is an instantaneous Darcy's equation utilizing the piston rate but corrected to achieve the formation rate. The correction constitutes the important feature of the FRA method. A plot of p(t) versus the formation rate, given in Eq. 3 as the term in parentheses, should result in a straight line with a negative slope and intercept at p*.

The methods described herein utilize certain aspects of the known FRA techniques, and provide improved testing and reduced test time through real time verification. In one aspect, verification is performed by multiple draw cycles, while in other aspects a single draw cycle is used and self verified.

According to the present invention, a quality indicator or factor $R^2$ is derived from a best straight-line fit to the FRA data. The quality indicator is derived analytically using, for example, a least squares method to determine how well the data points fit the straight line. The quality indicator is preferably a dimensionless number between 0 and 1. Currently, a quality indicator of about 0.95 or higher is considered indicative of a good test for verification purposes.

During a single cycle of a drawdown test using the methods of the present invention, formation flow rate can be measured in cubic centimeters per second (cm3/s). Pressure response of the system volume 204 in the case of large volume systems or test volume 204 is influenced by fluid flow from the formation. The pressure response is measured in pounds per square inch (psi) or in bars (bar) using the sensor 206. Pressure response curves can be plotted or otherwise collected electronically to obtain multiple data points for use with multiple regression analysis techniques.

The method of the present invention enables determinations of mobility (m), fluid compressibility (C) and formation pressure (p*) to be made during the drawdown portion of the cycle by varying the draw rate of the system between the drawdown portions. This early determination allows for earlier control of drilling system parameters based on the calculated p*, which improves overall system performance and control quality. According to the present invention, the same determinations are used for optimizing subsequent tests or test portions by using the information to set control parameters used by the controller 210 in controlling speed, volume, delta pressure and piston position in the draw down unit 202.

One method according to the present invention utilizes the capability of a closed loop draw down system as described above and shown in FIG. 2 to optimize successive test cycles or test portions in making determinations of formation parameters.

A preferred method using either FRA methods or variable draw rates as described above includes separating either a single cycle or multiple test cycles into successive test portions. A test is initiated and formation parameters, e.g., pressure, mobility, compressibility and test quality indicators are determined during the first test portion. The first test portion might be a draw down portion to determine compressibility, for example, or the first test portion might include a draw and build-up cycle to determine a first iteration of formation pressure.

The determinations made during the first test portion are then used to set test parameters used by the draw down unit 200 to conduct more efficiently the succeeding test portion. In previous methods using successive tests or test portions, each successive test portion is typically undertaken with predetermined values for draw period, volume change rate, delta-pressure, etc. . . . The present invention determines next-step parameters in real-time using the down hole processor in the controller 210 based in part on measurements and determinations in the immediately preceding test portion.

Test Options

The present invention provides the capability to perform different test methods to enable test verification by altering the test method for a particular draw down test. The apparatus can also be programmed to perform a standard draw down test, which can then be verified by subsequent cycles initiated according to the present invention. Exemplary options without limiting the scope of the present invention include 1) a standard test using a drawdown and build-up test with fixed volume and rate within a defined test duration, 2) repeated drawdown and buildup tests with different drawdown rates, and 3) successive drawdown tests with different rates followed by a pressure buildup. All tests can terminate when a predetermined time window is exceeded or when the pressure buildup is decreasing under a given rate.

Figure 4A:
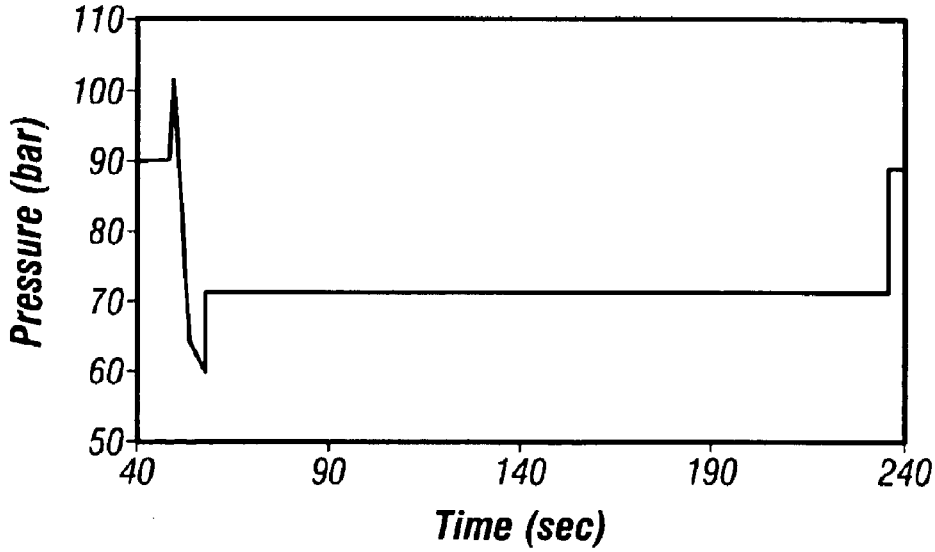
FIG. 4A shows a standard draw down test cycle.
Figure 4B:
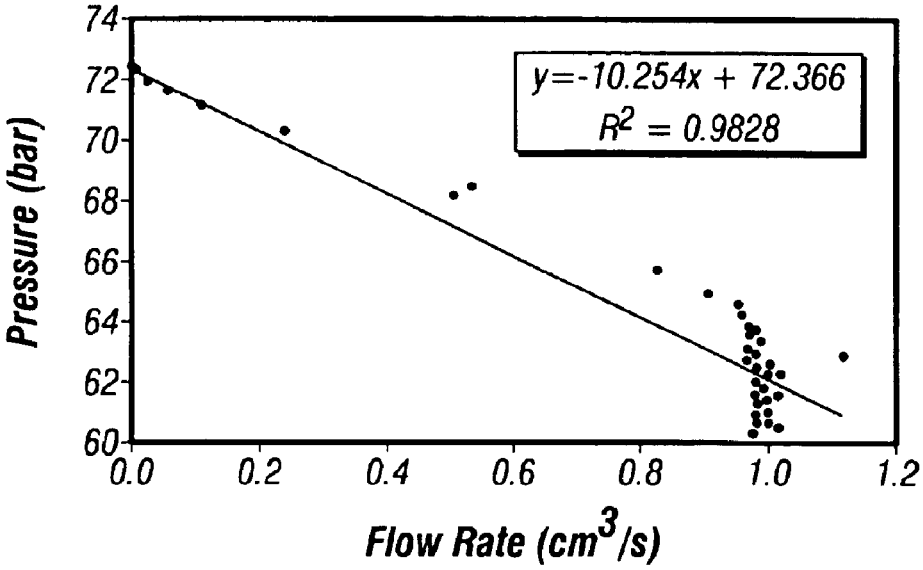
FIG. 4B shows a flow rate plot associated with the standard draw down test cycle of FIG. 4A along with a quality indicator according to the present invention.
Figure 4C:
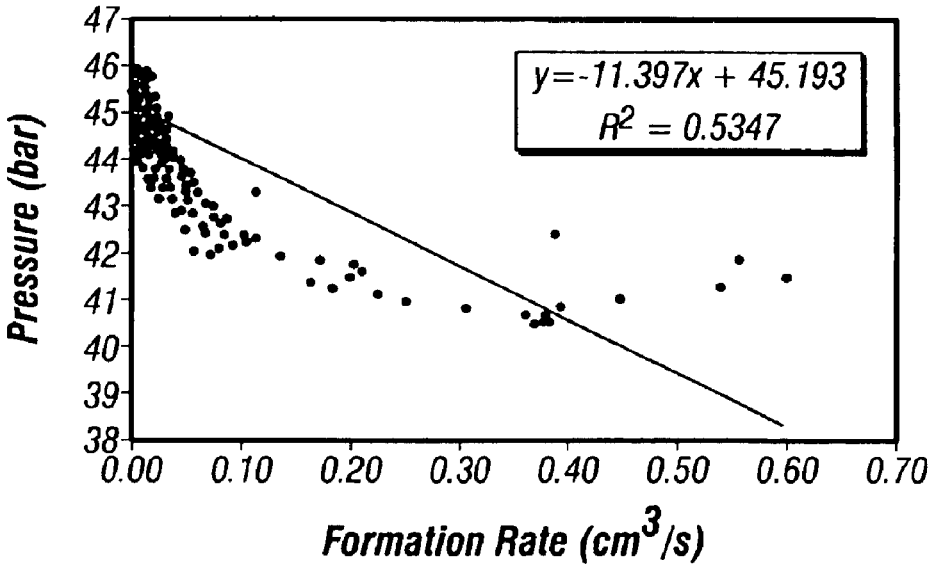
FIG. 4C is an example of a test having a low quality indicator.

FIGS. 4A–B show test-derived plots of a standard draw down test. FIG. 4A shows a plot of pressure vs. time of a single draw cycle. FIG. 4B shows pressure vs. flow rate. A quality indicator of 0.98 is indicated by this particular data set, thus the test would be considered a good test. FIG. 4C shows another test-derived flow rate plot to show the result of a test having a low quality indicator.

Optimized Repeat Test

The optimized repeated drawdown and buildup test includes performing several draw cycle tests in sequence and comparing the resultant pressures for repeatability. If the buildup pressures are not reading the correct formation pressure, then the pressures will not repeat within an acceptable margin (generally less than the gauge repeatability). During the repeat tests, different drawdown rates can be used based on the down hole analysis results of the prior test. The down hole control system analyzes each pressure test result with Formation Rate Analysis and optimizes the drawdown rate, volume, and buildup durations based on the FRA quality indicator and determined formation mobility. Such repeat tests validate the tests. If the buildup criteria are met in conjunction with an acceptable quality indicator, the test can be aborted early to avoid unnecessary cycles and to reduce the test times.

Figure 5A:
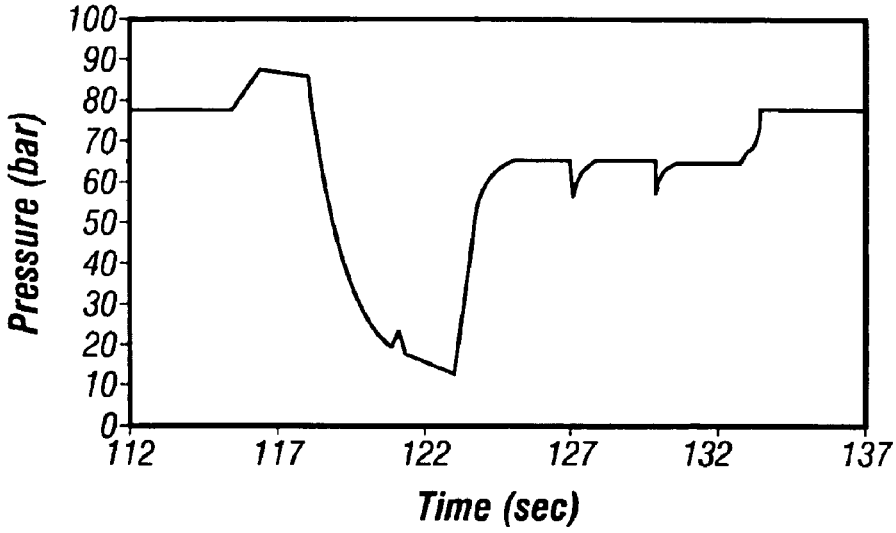
FIGS. 5A–B show one method of formation testing according to the present invention using multiple draw cycles.
Figure 5B:
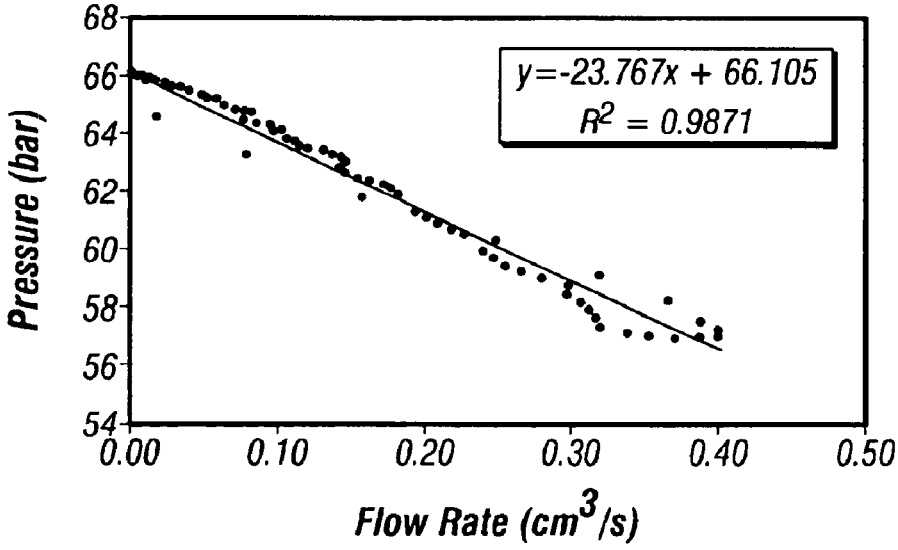

FIGS. 5A–5B show test-derived plots of an optimized repeat draw down test according to the present invention. Note that parameters for each test portion following an initial test portion have been modified to reduce the delta pressure between the tool and formation pressure. This procedure optimizes the succeeding tests by reducing build-up time. Furthermore, the draw rate in each succeeding test is optimized based on the initial test portion to ensure the draw rate does not exceed the bubble point of the fluid.

Successive Drawdown

Another method according to the present invention provides successive drawdowns prior to a buildup test. The successive draw downs are preferably performed with different draw rates followed by a pressure buildup test portion. Hence, in this type of test there is only one formation pressure reading. An advantage of this test procedure is to ensure communication with the formation during drawdowns. If the probe or pad seal 126 is securely connected to the formation during the all successive drawdown test portions, then the FRA plot of the entire test set will generate a single straight line. Even though drawdown rates are different, the tests will respond to the same formation mobility, and the slope of the FRA plot will be the same for the different drawdown rates. Moreover, the resultant buildup will lead to the formation pressure with more confidence after verifying the seal and flow rates through the draw down portions.

Figure 6A:
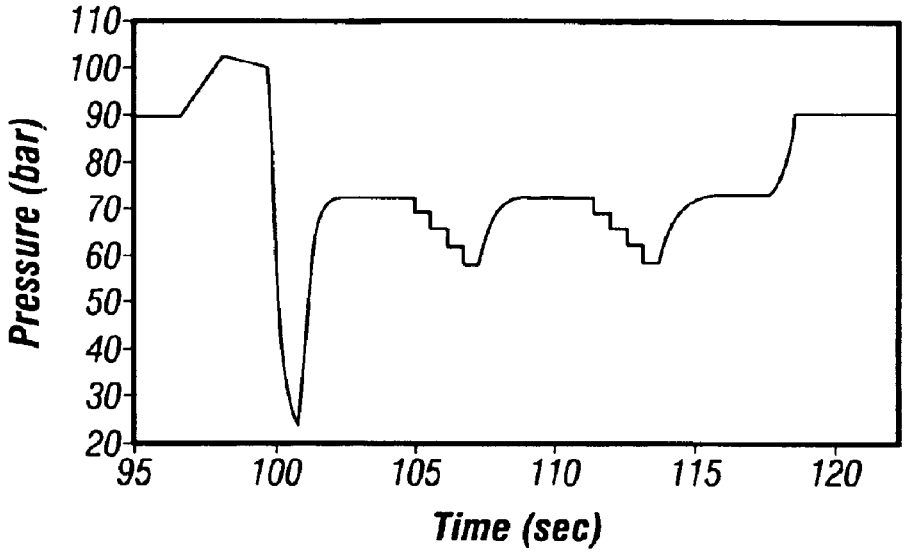
FIGS. 6A–B illustrate another method of formation testing according to the present invention using multiple draw cycles and stepped-draw down.
Figure 6B:
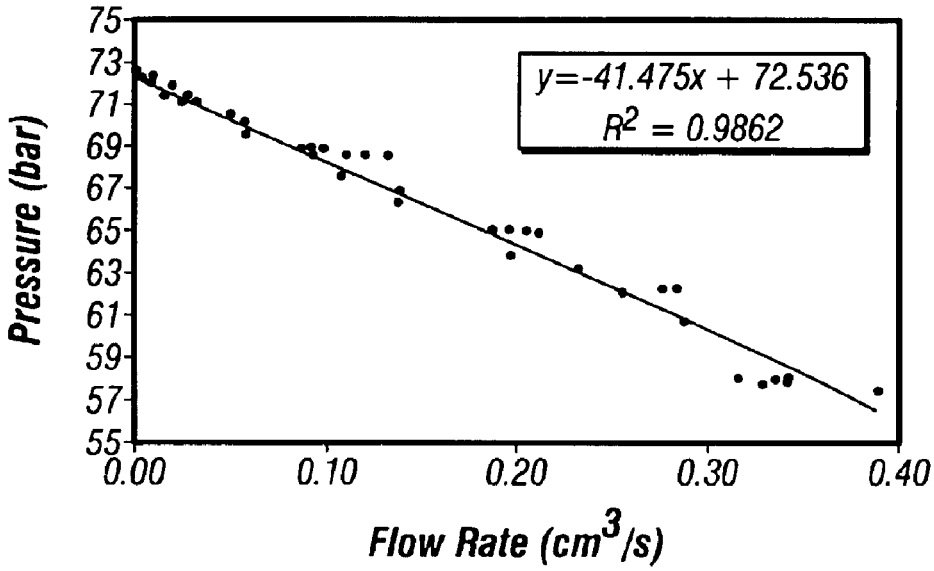

FIGS. 6A–6B show test-derived plots of one version of the successive draw down test as described above. The initial draw here is shown as a standard draw test. This happens to be the protocol used for this particular test. A standard draw down cycle for the initial test portion, however, is not required. The second test portion of the plot in FIG. 6A a variation of the successive draw down test whereby each successive draw down provides a portion with substantially steady-state flow. The overall draw down portion then looks like a single stair-stepped draw down. The flow rate plot of FIG. 6B is based on the test of FIG. 6A. FIG. 6B shows that the flow rate data points between the test start and end points are much more numerous than in the standard draw cycle of FIG. 4B. Thus, the straight-line fit more accurately represents the data and the quality indicator 0.9862 is slightly higher as well.

The above-described methods are exemplary of tests associated with the present invention and are not intended to limit the scope or the present method or to exclude other test options. For example the first test portion can include the controller might utilize signals from either the sensors 220 to determine a tool characteristic such as piston speed, position or test volume pressure, and/or the controller could utilize signals from the formation property sensor 206 to determine a formation characteristic during the first test portion to set test parameters for the second test portion. Then, the second test portion can include using signals from either the tool sensors 220 or formation property sensor 206 to determine a second characteristic, tool and/or formation, during the second test portion. Then the processor in the controller 210 can evaluate the characteristics using FRA or other useful technique to determine a desired formation parameter, e.g., pressure, compressibility, flow rate, resistivity, dielectric, chemical properties, neutron porosity etc. . . . , depending on the particular sensor or sensors selected.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

What is claimed is:

1. A method of determining in situ a desired formation parameter of interest comprising:

a) conveying a tool into a well borehole traversing a formation;

b) placing the tool into communication with the formation to test the formation, the test including a first test portion and a second test portion;

c) determining a first characteristic during the first test portion;

d) initiating the second test portion, the second test portion having test parameters determined at least in part by the determinations made during the first test portion;

e) determining a second characteristic during the second test portion; and f) determining the desired formation parameter from one or more of the first characteristic and the second characteristic.

2. The method of claim 1, wherein the first test portion includes increasing a test volume in the tool at a first rate for a predetermined time interval.

3. The method of claim 2, wherein the first test portion includes a multi-rate draw down.

4. The method of claim 3, wherein the multi-rate draw down includes a step-wise draw down.

5. The method of claim 2, wherein the first test portion includes drawing the test volume pressure below the formation pressure and controlling the draw rate to create substantial equilibrium between the draw rate and flow rate into the tool.

6. The method of claim 1, wherein the first test portion includes determining one or more of i) formation mobility; ii) formation pressure; iii) fluid compressibility; and iv) a quality indicator.

7. The method of claim 1, wherein the second test portion includes increasing a test volume in the tool at a second rate for a predetermined time interval.

8. The method of claim 7, wherein the second test portion includes a multi-rate draw down.

9. The method of claim 8, wherein the multi-rate draw down includes a step-wise draw down.

10. The method of claim 7, wherein the second test portion includes drawing the test volume pressure below the formation pressure and controlling the draw rate to create substantial equilibrium between the draw rate and flow rate into the tool.

11. The method of claim 1, wherein the second test portion includes determining one or more of i) formation mobility; ii) formation pressure; iii) fluid compressibility; and iv) a quality indicator.

12. The method of claim 1, wherein the first test portion includes increasing a test volume in the tool at a first rate for a predetermined time period, holding the test volume at a constant volume to allow a test volume pressure to stabilize, the test parameters for the second test portion including a second rate for increasing the test volume, the second rate not equaling the first draw rate.

13. The method of claim 1, wherein the second test portion includes aborting the test, wherein the desired formation parameter is determined based in part on the determined characteristic.

14. The method of claim 1, wherein formation rate analysis is used in determining the first characteristic.

15. The method of claim 1, wherein formation rate analysis is used in determining the second characteristic.

* * * * *